US007540711B2

(12) United States Patent
Arai et al.

(10) Patent No.: US 7,540,711 B2
(45) Date of Patent: Jun. 2, 2009

(54) HEAT RESISTING STEEL, STEAM TURBINE ROTOR SHAFT USING THE STEEL, STEAM TURBINE, AND STEAM TURBINE POWER PLANT

(75) Inventors: Masahiko Arai, Hitachinaka (JP); Hirotsugu Kawanaka, Hitachi (JP); Kennichi Murata, Hitachi (JP); Hideo Yoda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 521 days.

(21) Appl. No.: 11/172,929

(22) Filed: Jul. 5, 2005

(65) Prior Publication Data

US 2006/0216145 A1 Sep. 28, 2006

(30) Foreign Application Priority Data

Jul. 6, 2004 (JP) ..... 2004-198963

(51) Int. Cl.
*F04D 29/04* (2006.01)

(52) U.S. Cl. ..... 415/216.1; 148/335; 420/109

(58) Field of Classification Search ..... 415/216.1; 148/335; 420/109
See application file for complete search history.

(56) References Cited

U.S. PATENT DOCUMENTS

| | | | | |
|---|---|---|---|---|
| 6,123,504 | A * | 9/2000 | Shiga et al. | 415/200 |
| 6,358,004 | B1 * | 3/2002 | Shiga et al. | 415/200 |
| 6,575,700 | B2 | 6/2003 | Arai et al. | |

FOREIGN PATENT DOCUMENTS

| | | |
|---|---|---|
| JP | 9-41076 | 2/1997 |
| JP | 9-194987 | 7/1997 |
| JP | 9-268343 | 10/1997 |
| JP | 10-183294 | 7/1998 |
| JP | 11-286741 | 10/1999 |

* cited by examiner

*Primary Examiner*—Edward Look
*Assistant Examiner*—Aaron R Eastman
(74) *Attorney, Agent, or Firm*—Mattingly & Malur, P.C.

(57) ABSTRACT

The invention provides a heat resisting steel having superior high-temperature strength and notch rupture strength, a rotor shaft using the heat resisting steel, a steam turbine using the rotor shaft, and a power plant using the steam turbine. The heat resisting steel is made of a Cr—Mo—V low-alloy steel containing 0.15-0.40% by weight of C, not more than 0.5% of Si, 0.05-0.50% of Mn, 0.5-1.5% of Ni, 0.8-1.5% of Cr, 0.8-1.8% of Mo and 0.05-0.35% of V, and having a (Ni/Mn) ratio of 3.0-10.0.

19 Claims, 14 Drawing Sheets

HEAT RESISTING STEEL, STEAM TURBINE ROTOR SHAFT USING THE STEEL, STEAM TURBINE, AND STEAM TURBINE POWER PLANT

BACKGROUND OF THE INVENTION

1. Field of the Invention

The present invention relates to a novel heat resisting steel which is made of a Cr—Mo—V low-alloy steel and has superior high-temperature strength and superior anti-creep brittleness and which is used for rotor shafts of high-pressure, intermediate-pressure and high/intermediate-pressure steam turbines. The present invention also relates to a rotor shaft using the heat resisting steel, a steam turbine using the rotor shaft, and a power plant using the steam turbine.

2. Description of the Related Art In general, a Cr—Mo—V low-alloy steel according to ASTM standards (Designation: A470 class 8) is employed for high-pressure, intermediate-pressure and high/intermediate-pressure turbine rotors which are subjected to steam at high temperatures (steam temperatures of 538 to 566° C.). Recently, an improvement in power generation efficiency of steam turbines has been demanded from the viewpoint of energy saving, and an increase of steam temperature in a thermal power plant has been put into practice because increasing the steam temperature and pressure is a most effective measure to improve the power generation efficiency. At high temperatures in the range of steam temperatures of 566 to 600° C. including ultra super critical pressure, a 12%-Cr steel having high durable temperature and superior anti-environment characteristics is employed. Power generation at higher efficiency can save fossil fuel, reduce the amount of exhaust gases generated, and contribute to protecting global environments.

Patent Reference 1; JP,A 10-183294 discloses a heat resisting steel made of a Cr—Mo—V low-alloy steel, which contains 0.15-0.40% by weight of C, not more than 0.1% of Si, 0.05-0.25% of Mn, 1.5-2.5% of Ni, 0.8-2.5% of Cr, 0.8-2.5% of Mo and 0.15-0.35% of V, and which has a (Mn/Ni) ratio of not more than 0.12, i.e., a (Ni/Mn) ratio of not less than 8.3, and also discloses a high/low-pressure integral steam turbine employing the heat resisting steel for a rotor shaft.

Patent Reference 2; JP,A 9-41076 discloses that a Cr—Mo—V low-alloy steel containing 0.1-0.3% by weight of C, not more than 0.05% of Si, not more than 0.1% of Mn, 0.1-1.5% of Ni, 0.5-3% of Cr, 0.05-0.5% of Mo, 0.1-0.35% of V, 0.01-0.15% of Nb, 0.5-2% of W, and 0.001-0.01% of B is employed in a high/low-pressure integral steam turbine, i.e., as materials of rotors on the high- and low-pressure sides of the steam turbine.

Patent Reference 3; JP,A 9-194987 discloses that a Cr—Mo—V low-alloy steel containing 0.05-0.15% by weight of C, 0.005-0.3% of Si, 0.01-1.0% of Mn, 0.1-2.0% of Ni, 0.8-1.5% of Cr, 0.1-1.5% of Mo, 0.05-0.3% of V, and 0.1-2.5% of W is employed for a high-temperature rotor of a steam turbine.

Patent Reference 4; JP,A 9-268343 discloses that a Cr—Mo—V low-alloy steel containing 0.05-0.30% by weight of C, 0.005-0.3% of Si, 0.01-1.0% of Mn, 0.1-2.0% of Ni, 0.8-3.5% of Cr, 0.1-2.5% of Mo, 0.05-0.4% of V, and 0.1-3.5% of Co is employed for a high-temperature rotor of a steam turbine.

SUMMARY OF THE INVENTION

However, the use of the 12%-Cr steel used in an ultra super critical-pressure power plant (above 593° C.) designed to be adapted for an increase of the steam temperature is less economical than and inferior in manufacturability to the use of the low-alloy steel. Also, the operation and management techniques of the ultra super critical-pressure power plant designed to be adapted for an increase in temperatures of boiler and turbine members require an advanced level, and hence push up not only the construction cost, but also the operation, maintenance and check costs.

On the other hand, if low-alloy steel materials having manufacturability and mechanical properties equal or superior to the known Cr—Mo—V low-alloy steels can be used at the steam temperatures of 538 to 566° C. in the known steam turbines, it is possible to increase the plant output without requiring more severe steam conditions, and to construct a turbine with higher performance.

Furthermore, any of the known Cr—Mo—V low-alloy steels disclosed in Patent References 1 to 4 is not sufficient in high-temperature strength and notch rupture strength.

It is an object of the present invention to provide a heat resisting steel superior in high-temperature strength and notch rupture strength, a rotor shaft using the heat resisting steel, a steam turbine using the rotor shaft, and a power plant using the steam turbine.

To achieve the above object, the present invention provides a heat resisting steel made of a Cr—Mo—V low-alloy steel containing 0.15-0.40% by weight of C, not more than 0.5% of Si, 0.05-0.50% of Mn, 0.5-1.5% of Ni, 0.8-1.5% of Cr, 0.8-1.8% of Mo and 0.05-0.35% of V, and having a (Ni/Mn) ratio of 3.0-10.0.

Preferably, the heat resisting steel according to the present invention is made of a Cr—Mo—V low-alloy steel containing 0.23-0.32% by weight of C, 0.01-0.05% of Si, 0.15-0.35% of Mn, 0.7-1.2% of Ni, 0.8-1.5% of Cr, 0.8-1.8% of Mo and 0.10-0.30% of V, and having a (Ni/Mn) ratio of 3.0-10.0.

Further, the heat resisting steel is preferably made of the Cr—Mo—V low-alloy steel modified in composition to contain 0.65-0.95% of Ni and to have a (Ni/Mn) ratio of 3.5-7.0, or made of the Cr—Mo—V low-alloy steel modified in composition to contain 0.95-1.35% of Ni and to have a (Ni/Mn) ratio of 4-8, or made of the Cr—Mo—V low-alloy steel modified in composition to contain 1.35-1.5% of Ni and to have a (Ni/Mn) ratio of 5.5-10.0.

As an alternative, the heat resisting steel is preferably made of the Cr—Mo—V low-alloy steel modified in composition to contain 0.5-1.5% of Ni and to have a (Cr/Mn) ratio of 3.5-14.0. More preferably, the heat resisting steel is made of the Cr—Mo—V low-alloy steel modified in composition to contain 0.65-0.95% of Ni and to have a (Cr/Mn) ratio of 3.0-9.0, or made of the Cr—Mo—V low-alloy steel modified in composition to contain 0.95-1.35% of Ni and to have a (Cr/Mn) ratio of 3.5-8.5, or made of the Cr—Mo—V low-alloy steel modified in composition to contain 1.35-1.5% of Ni and to have a (Cr/Mn) ratio of 5.0-8.0.

The Cr—Mo—V low-alloy steel has smooth-gauge creep rupture strength of not less than preferably 150 MPa, more preferably 170 MPa, and most preferably 180 MPa on condition of 538° C.×100,000 hours.

As a test method for evaluating a creep embitterment characteristic, there is a notch creep test using a test piece with a notch formed between marked points on the test piece. In the notch creep test, multi-axis stresses are developed so as to restrain deformations of a notched portion, and a material having high ductility ruptures at the lapse of a longer time than the rupture time of a smooth-gauge creep, thus showing a notch reinforcing effect. However, if the material ductility lowers with the progress of embitterment during the test, such a material ruptures at the lapse of a shorter time than the rupture time of the smooth-gauge creep, thus showing a notch weakening effect. From the viewpoint of the creep embitterment characteristic, it is desired that a ratio of (rupture time of a notched sample/rupture time of a smooth gauge sample) is preferably not less than 2 and more preferably not less than 2.5. Reasons why the composition of the heat resisting steel should be defined as stated in claims will be described below.

C is an element required to improve harden ability and to ensure sufficient strength. If the C amount is not more than 0.15%, sufficient harden ability could not be obtained, thus producing a soft ferrite structure at the center of a rotor, whereby tensile strength and proof stress could not be obtained at a sufficient level. On the other hand, if the C amount is not less than 0.40%, toughness would be reduced. For those reasons, the C amount is limited to the range of 0.15-0.40%. In particular, a preferable range of the C amount is 0.20-0.35%, and a more preferable range is 0.23-0.32%.

Si serves as a deoxidizer, and Mn serves as a deoxidizer and a desulfurizer. These elements are added in a melting process of the steel and are effective even with a small amount. In the case utilizing the carbon vacuum deoxidizing method, the electro slag remolding method, or the like, there is no need of adding Si, and hence no-addition of Si is desired. The Si amount is preferably not more than 0.50%, more preferably 0.10%, and most preferably 0.05%.

Addition of an appropriate amount of Mn acts to fixate, as a sulfide MnS, S that is present in the steel as a harmful impurity element and deteriorates hot workability. Thus, because the addition of an appropriate amount of Mn is effective in reducing the harmful effect of S, the Mn amount should be not less than 0.05% in production of a large-sized forging, such as a rotor shaft for a steam turbine. On the other hand, adding Mn in a large amount would tend to cause creep embitterment and develop the notch weakening effect. Therefore, the Mn amount is set to be not more than 0.5%. In particular, the range of the Mn amount is preferably 0.10-0.40% and more preferably 0.15-0.35%.

Ni is an element essential to improve harden ability and toughness. If the Ni amount is less than 0.5%, the effect of improving toughness could not be obtained at a sufficient level. On the other hand, adding a large amount of Ni in excess of 1.5% would reduce the creep rupture strength. In particular, the range of the Ni amount is preferably 0.6-1.3% and more preferably 0.7-1.2%. Further, as mentioned above, the steel exhibits different characteristics depending on the (Ni/Mn) ratio and the (Cr/Mn) ratio. Stated another way, the (Ni/Mn) ratio and the (Cr/Mn) ratio have respective preferable ranges for different ranges of the Ni amount, i.e., 0.65-0.95%, 0.95-1.35%, and 1.35-1.5%. In particular, the respective ranges of the Ni amount are preferably not more than 0.65%, but less than 0.95%, not more than 0.95%, but less than 1.35%, and 1.35% -1.5%, and more preferably 0.65-0.9%, 0.95-1.3%, and 1.35-1.5%.

Cr is effective in improving not only harden ability, but also toughness and strength. Cr is also effective in improving corrosion resistance in steam. If the Cr amount is less than 0.8%, those effects could not be obtained at a sufficient level. On the other hand, adding a large amount of Cr in excess of 1.5% would reduce the creep rupture strength. In particular, the range of the Cr amount is preferably 0.9-1.4% and more preferably 1.0-1.3%.

Mo is effective in precipitating fine carbides in crystal grains during a tempering process, thereby improving high-temperature strength and preventing tempering embrittlement. If the Mo amount is less than 0.8%, those effects could not be obtained at a sufficient level. On the other hand, adding Mo in excess of 1.8% would reduce toughness. In particular, from the viewpoint of toughness, the range of the Mo amount is preferably 1.0-1.6% and more preferably 1.2-1.5%.

As a result of experiments made on a small steel ingot, it has been clarified that, like Mo, W is an element effective in precipitating fine carbides, thereby improving high-temperature strength and preventing tempering embrittlement. However, it has also been clarified that the effects of Mo and W upon the high-temperature strength differ from each other depending on test temperature, and addition of Mo is more effective at temperatures of not higher than 566° C., i.e., in the temperature range for applications of the steel of the invention. The experiment result has further clarified that W tends to cause segregation in production of a large-sized steel ingot, such as used in manufacturing a rotor shaft for a steam turbine, and addition of W rather gives rise to a reduction of the strength and toughness. For those reasons, W is not added to the steel of the invention.

V is effective in precipitating fine carbides in crystal grains during a tempering process, thereby improving high-temperature strength and toughness. If the V amount is less than 0.05%, those effects could not be obtained at a sufficient level. On the other hand, adding V in excess of 0.35% would reach saturation of the effects. In particular, the range of the V amount is preferably 0.15-0.33% and more preferably 0.20-0.30%.

Like V, Nb is an element contributable to precipitating fine carbides, thereby improving high-temperature strength and toughness. As a result of experiments made on a small steel ingot, it has been clarified that combined addition of Nab with V provides an effect of greatly improving the strength. However, the experiment result has further clarified that Nb tends to cause segregation in production of a steel ingot for a large-sized forging, such as a rotor shaft for a steam turbine, at the center of the steel ingot, and addition of Nb rather gives rise to a reduction of the strength and toughness. For those reasons, Nb is not added to the steel of the invention.

It has been experimentally clarified that Mn, Ni and Cr are significantly related to the high-temperature strength and the creep embrittlement characteristic, and these elements develop combined actions in the steel of the invention. More specifically, in order to obtain material characteristics including superior high-temperature strength and a superior characteristic in resistance against creep embrittlement, it is preferred that a ratio of Ni acting to improve harden ability and toughness to Mn acting to promote the creep embrittlement, i.e., a (Ni/Mn) ratio, is set to be 3.0-10.0 and a ratio of Cr acting to improve harden ability and high-temperature strength to Mn acting to promote the creep embrittlement, i.e., a (Cr/Mn) ratio, is set to be 3.5-14.0. In addition, as described above, respective ranges of the (Ni/Mn) ratio and the (Cr/Mn) ratio are preferably set depending on the Ni amount.

In a process of melting the steel of the invention, adding one or more kinds of rare earth elements, Ca, Zr and Al contributes to improving toughness due to the effect of each added element itself and the resulting deoxidization effect. For that reason, the steel of the invention is preferably added with one or more kinds of those elements. When adding one or more of rare earth elements, the amount of less than 0.05% could not ensure the effect of improving toughness at a sufficient level, and the addition in excess of 0.4% would reach saturation of the effect. Ca is effective in improving toughness with addition of a small amount, but the amount of less than 0.0005% could not ensure the effect at a sufficient level. Conversely, the addition of Ca in excess of 0.01% would reach saturation of the effect. When adding Zr, the amount of less than 0.01% could not ensure the effect of improving toughness at a sufficient level, and the addition in excess of 0.2% would reach saturation of the effect. When adding Al, the amount of less than 0.001% could not ensure the effect of improving toughness at a sufficient level, and the addition in excess of 0.02% would reduce the creep rupture strength.

Oxygen affects the high-temperature strength, and a preferable range of oxygen is 5-25 ppm in which high creep rupture strength is obtained.

The amounts of P and S can be reduced with addition of Mn, rare earth elements, etc. Such a reduction in amounts of those elements is effective in increasing the creep rupture strength and toughness at low temperatures. It is therefore desired that the amounts of P and S be as small as possible. From the viewpoint of low-temperature toughness, the P amount is preferably not more than 0.020% and the S amount is also preferably not more than 0.020%. In particular, the amounts of P and S are each preferably not more than 0.015% and more preferably not more than 0.010%.

A reduction in amounts of Sb, Sn and As is also effective in increasing low-temperature toughness, and therefore the amounts of Sb, Sn and As are preferably as small as possible. From the viewpoint of current level of the steel-making technology, however, the Sb, Sn and As amounts are preferably not more than 0.0015%, 0.01% and 0.02%, and more preferably not more than 0.0010%, 0.005% and 0.01%, respectively.

Heat treatment of the steel of the invention is performed by first smoothly heating the steel at temperature enough to cause complete transformation to the Austenitic structure, i.e., in the range of 900° C. at minimum to 1000° C. at maximum, holding the steel in such a condition for a predetermined time, and then rapidly cooling it (preferably by oil cooling or water spraying). If the quenching temperature is lower than 900° C., high toughness could be obtained, but high creep rupture strength would be difficult to obtain. Conversely, if the quenching temperature is higher than 1000° C., high creep rupture strength could be obtained, but high toughness would be difficult to obtain.

Furthermore, preferably, the steel is subjected to tempering through the steps of heating the steel to temperature in the range of 630-700° C., holding the steel in such a condition for a predetermined time, and then cooling it, so that the steel has the totally tempered Bainite structure. If the tempering temperature is lower than 630° C., high toughness would be difficult to obtain, and if it is higher than 700° C., high creep rupture strength would be difficult to obtain. After the tempering, the strength and toughness can be further adjusted by repeating, as required, the tempering process of heating and holding the steel to temperature in the range of 630-700° C. and cooling it. Repeating the tempering process reduces the strength, but increases the toughness.

The Cr—Mo—V steel having the above-stated composition is preferably subjected to melting and refining in a basic electric furnace and a ladle refining furnace, respectively, and then subjected to vacuum casting while undergoing vacuum carbon deoxidization.

In addition, the present invention provides a steam turbine rotor shaft that is made of the above-described heat resisting steel. Also, the present invention provides a steam turbine comprising a rotor shaft, moving blades mounted to the rotor shaft, stator blades for guiding steam to flow toward the moving blades, and an inner casing for supporting the stator blades, the steam flowing into an initial stage of the moving blades and flowing out from a final stage thereof at high pressure, wherein the rotor shaft is formed of the above-mentioned rotor shaft.

The steam turbine according to the present invention is preferably any of a high-pressure steam turbine, an intermediate-pressure steam turbine, and a high/intermediate-pressure integral steam turbine in which the high-pressure steam turbine and the intermediate-pressure steam turbine are integrated with each other.

Also, according to the present invention, in a steam turbine power plant of tandem compound type comprising a high-pressure steam turbine, an intermediate-pressure steam turbine, one or two low-pressure steam turbines coupled in tandem, and a generator, at least one of the high-pressure steam turbine and the intermediate-pressure steam turbine is the above-mentioned steam turbine. Alternatively, in a steam turbine power plant of cross compound type that a high-pressure steam turbine, an intermediate-pressure steam turbine and a generator are arranged in tandem, one or two low-pressure steam turbines coupled in tandem and a generator are arranged in tandem, and steam exiting the intermediate-pressure steam turbine is supplied to the low-pressure steam turbine, at least one of the high-pressure steam turbine and the intermediate-pressure steam turbine is the above-mentioned steam turbine. Alternatively, in a steam turbine power plant of tandem compound type comprising a high/intermediate-pressure integral steam turbine in which a high-pressure steam turbine and an intermediate-pressure steam turbine are integrated with each other, one or two low-pressure steam turbines coupled in tandem, and a generator, the high/intermediate-pressure steam turbine is the above-mentioned steam turbine.

According to the present invention, it is possible to provide a heat resisting steel superior in high-temperature strength and notch rupture strength, a rotor shaft using the heat resisting steel, a steam turbine using the rotor shaft, and a power plant using the steam turbine.

REFERENCE NUMERALS

Figure 1:
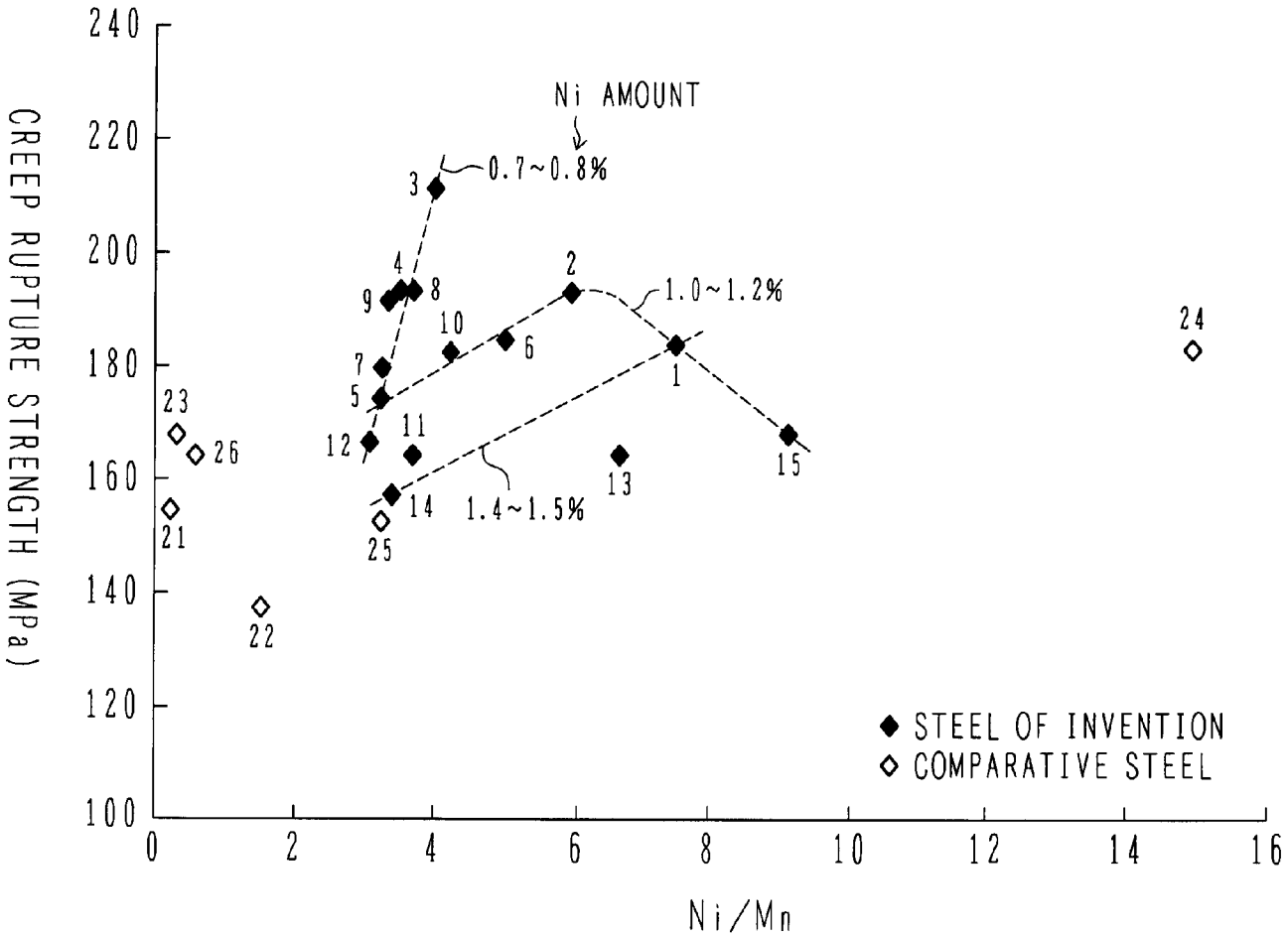
FIG. 1 is a graph showing the relationship between a (Ni/Mn) ratio and creep rupture strength.

1 . . . first bearing, 2 . . . second bearing, 3 . . . third bearing, 4 . . . fourth bearing, 5 . . . thrust bearing, 10 . . . first shaft packing, 11 . . . second shaft packing, 12 . . . third shaft packing, 14 . . . fourth shaft packing, 14 . . . high-pressure partition, 15 . . . intermediate-pressure partition, 16 . . . high-pressure moving blade, 17 . . . intermediate-pressure moving blade, 18 . . . high-pressure inner casing, 19 . . . high-pressure outer casing, 20 . . . intermediate-pressure first inner casing, 21 . . . intermediate-pressure second inner casing, 22 . . . intermediate-pressure outer casing, 23 . . . rotor shaft of high-pressure steam turbine, 24 . . . rotor shaft of intermediate-pressure steam turbine, 25 . . . flange/elbow, 26 . . . front bearing box, 27 . . . journal portion, 28 . . . main steam inlet, 29 . . . reheated steam inlet, 30 . . . high-pressure steam outlet, 31 . . . cylinder communicating pipe, 33 . . . rotor shaft of high/intermediate pressure steam turbine, 38 . . . nozzle box (high-pressure first stage), 39 . . . thrust bearing wear shutting-off device, 40 . . . warm-up steam inlet, 41 . . . moving blade, 42 . . . stator, 43 . . . bearing, and 44 . . . rotor shaft.

DESCRIPTION OF THE PREFERRED EMBODIMENTS

The best mode for carrying out the present invention will be described in detail below in connection with practical examples. It is however to be noted that the present invention is not limited to the following examples.

EXAMPLE 1

Table 1 shows the chemical composition (% by weight) of a heat resisting steel used for a steam turbine rotor shaft according to the present invention. Specifically, Table 1 shows the chemical composition (% by weight) of typical samples subjected to toughness and creep tests. Each sample is prepared as an experiment specimen by melting the heat resisting steel in a high-frequency melting furnace, forming a steel ingot, and hot forging the ingot into a 30-mm square piece at temperature in the range of 850-1150° C. Samples No. 1-15 represent the steel of the invention, and samples No. 21-26 each represent comparative steel. In particular, the sample No. 26 is made of steel corresponding to ASTM standards (Designation: A470 class 8). For simulating the conditions in a central portion of the steam turbine rotor shaft, those samples were each subjected to the steps of heating and holding the sample at 950° C. so that the sample was totally austenited, and then cooling it at a rate of 100° C./h for quench hardening. Subsequently, the sample was subjected to tempering through the steps of heating and holding the sample at 650° C. for 20 hours, and cooling it by air cooling. The Cr—Mo—V steel according to the present invention contains no ferrite phase and is of the totally Bainite structure.

TABLE 1

| Sample No. | C | Si | Mn | P | S | Ni | Cr | Mo | V | Fe | Ni/Mn | Cr/Mn |
|---|---|---|---|---|---|---|---|---|---|---|---|---|
| 1 | 0.25 | 0.03 | 0.20 | 0.002 | 0.006 | 1.5 | 1.2 | 1.3 | 0.25 | rest | 7.5 | 6.0 |
| 2 | 0.25 | 0.04 | 0.20 | 0.005 | 0.006 | 1.2 | 1.2 | 1.3 | 0.25 | rest | 6.0 | 6.0 |
| 3 | 0.28 | 0.05 | 0.20 | 0.004 | 0.007 | 0.8 | 1.2 | 1.3 | 0.25 | rest | 4.0 | 6.0 |
| 4 | 0.24 | 0.04 | 0.20 | 0.006 | 0.008 | 0.7 | 1.4 | 1.5 | 0.12 | rest | 3.5 | 7.0 |
| 5 | 0.23 | 0.03 | 0.31 | 0.004 | 0.006 | 1.0 | 1.3 | 1.7 | 0.22 | rest | 3.2 | 4.2 |
| 6 | 0.28 | 0.03 | 0.22 | 0.005 | 0.007 | 1.1 | 1.1 | 1.2 | 0.13 | rest | 5.0 | 5.0 |
| 7 | 0.20 | 0.03 | 0.25 | 0.006 | 0.007 | 0.8 | 0.9 | 0.9 | 0.28 | rest | 3.2 | 3.6 |
| 8 | 0.32 | 0.02 | 0.22 | 0.005 | 0.007 | 0.8 | 1.2 | 1.3 | 0.28 | rest | 3.6 | 5.5 |
| 9 | 0.25 | 0.01 | 0.18 | 0.007 | 0.006 | 0.6 | 1.4 | 1.3 | 0.25 | rest | 3.3 | 7.8 |
| 10 | 0.26 | 0.03 | 0.19 | 0.008 | 0.007 | 0.8 | 1.2 | 1.3 | 0.25 | rest | 4.2 | 6.3 |
| 11 | 0.27 | 0.03 | 0.25 | 0.004 | 0.006 | 0.9 | 0.9 | 1.5 | 0.25 | rest | 3.6 | 3.6 |
| 12 | 0.25 | 0.04 | 0.26 | 0.004 | 0.006 | 0.8 | 0.9 | 1.3 | 0.21 | rest | 3.1 | 3.5 |
| 13 | 0.24 | 0.03 | 0.21 | 0.005 | 0.006 | 1.4 | 1.2 | 1.7 | 0.21 | rest | 6.7 | 5.7 |
| 14 | 0.27 | 0.05 | 0.42 | 0.006 | 0.006 | 1.4 | 1.3 | 1.4 | 0.21 | rest | 3.3 | 3.1 |
| 15 | 0.24 | 0.21 | 0.12 | 0.004 | 0.007 | 1.1 | 1.4 | 1.3 | 0.26 | rest | 9.2 | 11.7 |
| 21 | 0.24 | 0.03 | 0.87 | 0.006 | 0.008 | 0.2 | 2.2 | 1.5 | 0.25 | rest | 0.2 | 2.5 |
| 22 | 0.26 | 0.03 | 1.20 | 0.006 | 0.007 | 1.8 | 1.9 | 1.6 | 0.26 | rest | 1.5 | 1.6 |
| 23 | 0.25 | 0.04 | 1.00 | 0.006 | 0.007 | 0.3 | 1.9 | 1.3 | 0.24 | rest | 0.3 | 1.9 |
| 24 | 0.25 | 0.06 | 0.02 | 0.007 | 0.007 | 0.3 | 1.9 | 1.3 | 0.25 | rest | 15.0 | 95.0 |
| 25 | 0.25 | 0.08 | 0.78 | 0.008 | 0.007 | 2.5 | 0.5 | 1.4 | 0.25 | rest | 3.2 | 0.6 |
| 26 | 0.25 | 0.32 | 0.81 | 0.008 | 0.007 | 0.47 | 1.2 | 1.3 | 0.25 | rest | 0.6 | 1.5 |

Table 2 shows the results of tensile, impact and creep rupture tests on each sample. Tensile strength is shown as the result of a room-temperature tensile test, and toughness is shown as 50%-FATT (Fracture Appearance Transition Temperature) obtained from the result of a V-notch Sharpy impact test. Creep rupture strength is shown as rupture strength measured on condition of 538° C.×$10^5$ hours according to the Larson-Miller method. In connection with a creep embrittlement rate represented by a ratio of (rupture time of a notched sample/rupture time of a smooth gauge sample), the steel samples of the invention except for No. 14 are still under notch rupture tests and are not yet ruptured. As seen from Table 2, the steel of the invention has the room-temperature tensile strength of not less than 725 MPa, the 0.02%-proof stress of not less than 585 MPa, FATT of not higher than 121° C., and the creep embrittlement rate of not less than 3. It can therefore be said that the steel of the invention is very effective as materials of a steam turbine rotor shaft for use in, as described later, a high-pressure steam turbine, an intermediate-pressure steam turbine, and a high/intermediate-pressure integral steam turbine in which the high-pressure steam turbine and the intermediate-pressure steam turbine are integrated with each other.

TABLE 2

| Sample No. | Tensile strength (MPa) | 0.02% Proof Stress (MPa) | Elongation (%) | Reduction of area (%) | 50% FATT (° C.) | Creep rupture strength* (MPa) | Creep Embrittelment rate | Notch rupture test |
|---|---|---|---|---|---|---|---|---|
| 1 | 875 | 690 | 18.7 | 59.9 | 80 | 184 | 3.2 | continued |
| 2 | 900 | 704 | 18.3 | 52.6 | 95 | 195 | 3.2 | continued |
| 3 | 914 | 707 | 17.3 | 49.4 | 103 | 212 | 3.2 | continued |
| 4 | 852 | 665 | 19.3 | 58.4 | 74 | 194 | 3.2 | continued |
| 5 | 844 | 699 | 17.3 | 55.6 | 70 | 175 | 3.2 | continued |
| 6 | 832 | 674 | 19.8 | 60.2 | 74 | 185 | 3.2 | continued |
| 7 | 815 | 650 | 17.4 | 58.1 | 95 | 180 | 3.2 | continued |
| 8 | 820 | 648 | 17.5 | 58.3 | 98 | 194 | 3.2 | continued |
| 9 | 887 | 704 | 17.3 | 54.8 | 112 | 192 | 3.2 | continued |
| 10 | 892 | 715 | 17.4 | 56.4 | 110 | 184 | 3.2 | continued |
| 11 | 782 | 620 | 18.1 | 57.9 | 94 | 165 | 3.2 | continued |
| 12 | 795 | 658 | 18.0 | 58.4 | 92 | 167 | 3.2 | continued |
| 13 | 780 | 647 | 19.2 | 63.2 | 42 | 164 | 3.2 | continued |
| 14 | 778 | 631 | 20.4 | 66.7 | 25 | 157 | 3.1 | ended |
| 15 | 813 | 666 | 18.7 | 60.4 | 67 | 168 | 3.2 | continued |
| 21 | 915 | 712 | 17.4 | 54.1 | 66 | 154 | 1.96 | ended |
| 22 | 875 | 674 | 17.2 | 64.2 | 12 | 137 | 2.1 | ended |
| 23 | 803 | 624 | 17.4 | 63.1 | 47 | 168 | 0.8 | ended |
| 24 | 812 | 634 | 15.4 | 51.8 | 154 | 184 | 0.7 | ended |
| 25 | 724 | 542 | 18.7 | 63.4 | −14 | 152 | 1.4 | ended |
| 26 | 812 | 647 | 17.6 | 57.4 | 95 | 164 | 1.5 | ended |

*Rupture strength on condition of 538° C. × $10^5$ hours

FIG. 1 is a graph showing the relationship between the (Ni/Mn) ratio and the creep rupture strength on condition of 538° C.×105 hours. The steel of the invention exhibits high creep rupture strength when the (Ni/Mn) ratio is in a specific range of 3.0-10. However, the creep rupture strength is reduced as the Ni amount gradually increases as indicated by lines representing 0.7-0.8%, 1.0-1.2% and 1.4-1.5%. More specifically, when the Ni amount is 0.7-0.8%, maximum creep rupture strength is obtained at the (Ni/Mn) ratio of 3.5-7.0. The creep rupture strength is slightly reduced when the Ni amount is 1.0-1.2%, and is further reduced when the Ni amount is 1.4-1.5%. In addition, a peak value of the creep rupture strength lowers with an increase of the Ni amount.

Figure 2:
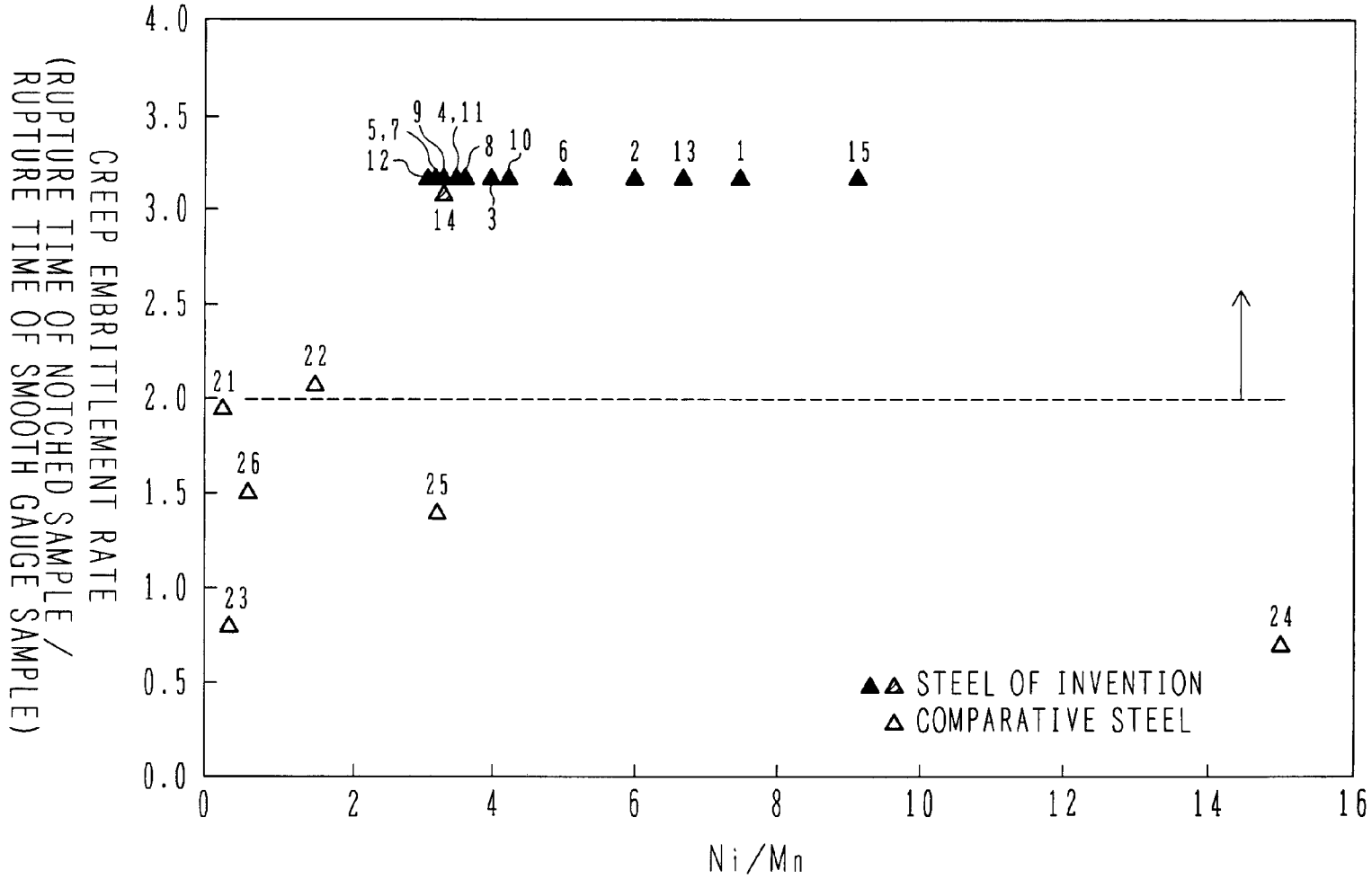
FIG. 2 is a graph showing the relationship between a (Ni/Mn) ratio and a creep embrittlement rate.

FIG. 2 is a graph showing the relationship between the (Ni/Mn) ratio, i.e., the ratio of Ni acting to improve toughness to Mn acting to promote creep embrittlement, and the creep embrittlement rate, i.e., the ratio of (rupture time of a notched sample/rupture time of a smooth gauge sample), for the rupture strength on condition of 538° C.×$10^5$ hours. The notch rupture tests on the steel samples of the invention except for No. 14, indicated by an arrow in FIG. 2, are still continued. The creep rupture strength has a general tendency to increase as the (Ni/Mn) ratio increases. The notch rupture strength is reduced at the (Ni/Mn) ratio of being outside the range of 3-10, and therefore the range of the (Ni/Mn) ratio for the steel of the invention is preferably set as mentioned above from the viewpoint of creep embrittlement.

Figure 3:
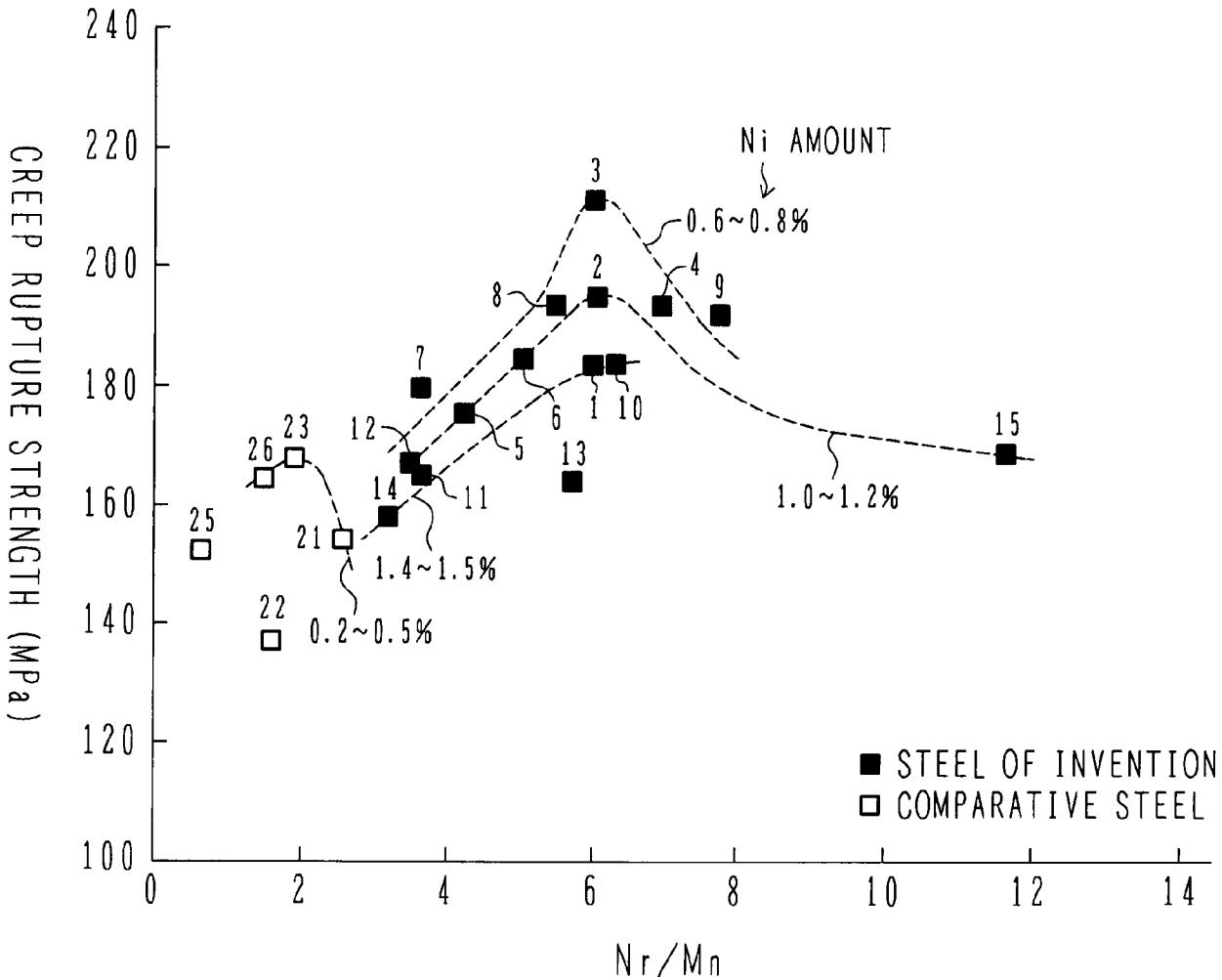
FIG. 3 is a graph showing the relationship between a (Cr/Mn) ratio and creep rupture strength.

FIG. 3 is a graph showing the relationship between the (Cr/Mn) ratio and the creep rupture strength on condition of 538° C.×$10^5$ hours. The steel of the invention exhibits high creep rupture strength when the (Cr/Mn) ratio is in a specific range of 3.5-10. However, the creep rupture strength is reduced as the Ni amount gradually increases as indicated by lines representing 0.6-0.8%, 1.0-1.2% and 1.4-1.5%. More specifically, when the Ni amount is 0.6-0.8%, maximum creep rupture strength is obtained at the (Cr/Mn) ratio of 3.0-9.0. The creep rupture strength is slightly reduced at the (Cr/Mn) ratio of 3.5-8.5 when the Ni amount is 1.0-1.2%, and it is further reduced at the (Cr/Mn) ratio of 3.5-8.5 when the Ni amount is 1.4-1.5%. In addition, a peak value of the creep rupture strength lowers with an increase of the Ni amount.

Figure 4:
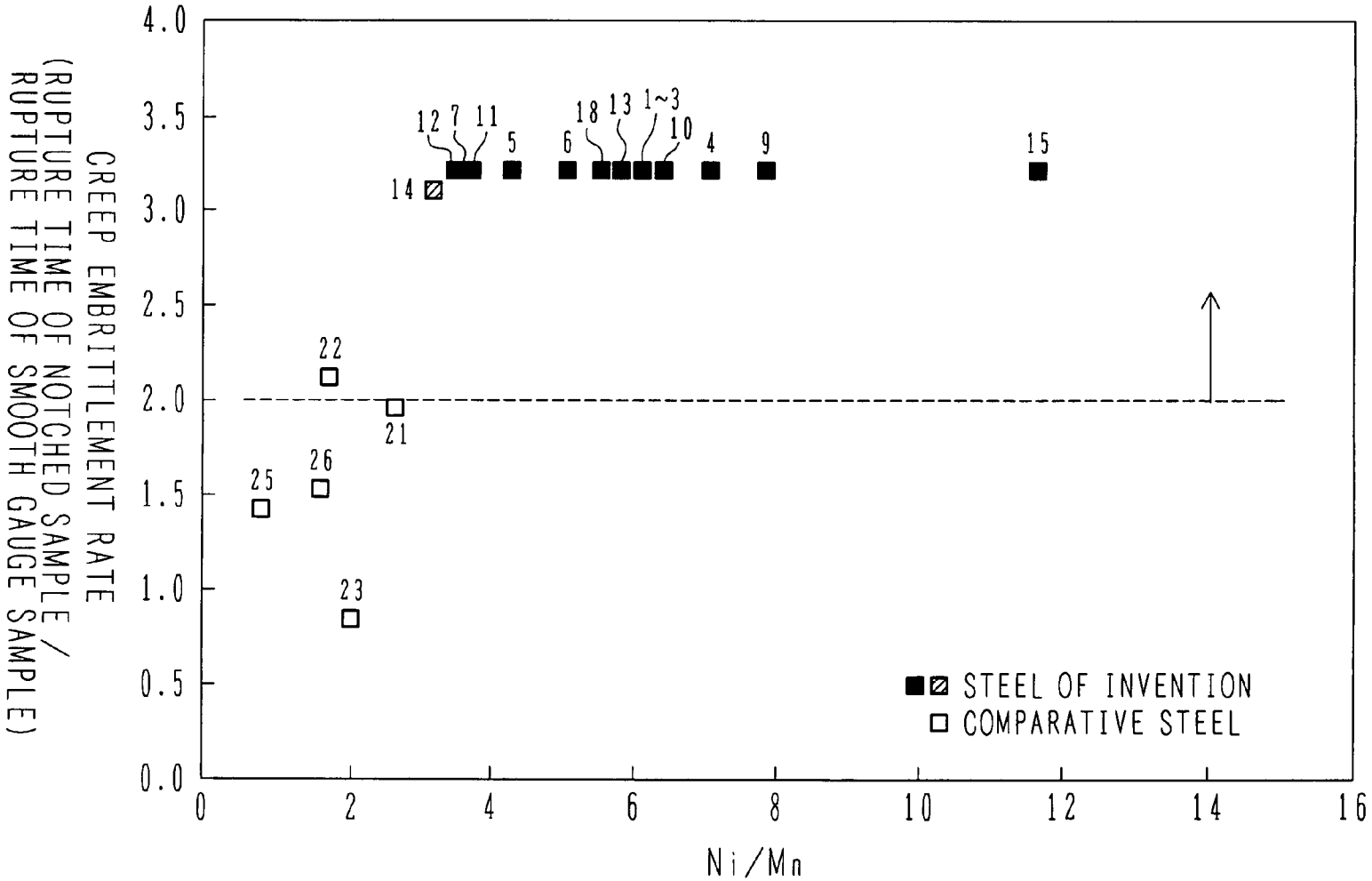
FIG. 4 is a graph showing the relationship between a (Cr/Mn) ratio and a creep embrittlement rate.

FIG. 4 is a graph showing the relationship between the (Cr/Mn) ratio, i.e., the ratio of Cr acting to improve both harden ability and high-temperature strength to Mn acting to promote creep embrittlement, and the creep embrittlement rate for the rupture strength on condition of 538° C.×$10^5$ hours. The notch rupture test on the steel samples of the invention except for No. 14 is still continued. Though not plotted in the graph, the sample No. 24 has a high (Cr/Mn) ratio of 95 and shows the notch weakening effect. The creep rupture strength has a general tendency to increase as the (Cr/Mn) ratio increases. The notch rupture strength is reduced at the (Cr/Mn) ratio of not more than 3.5 and not less than 14, and therefore the range of the (Cr/Mn) ratio for the steel of the invention is preferably set as mentioned above from the viewpoint of creep embrittlement.

Figure 5:
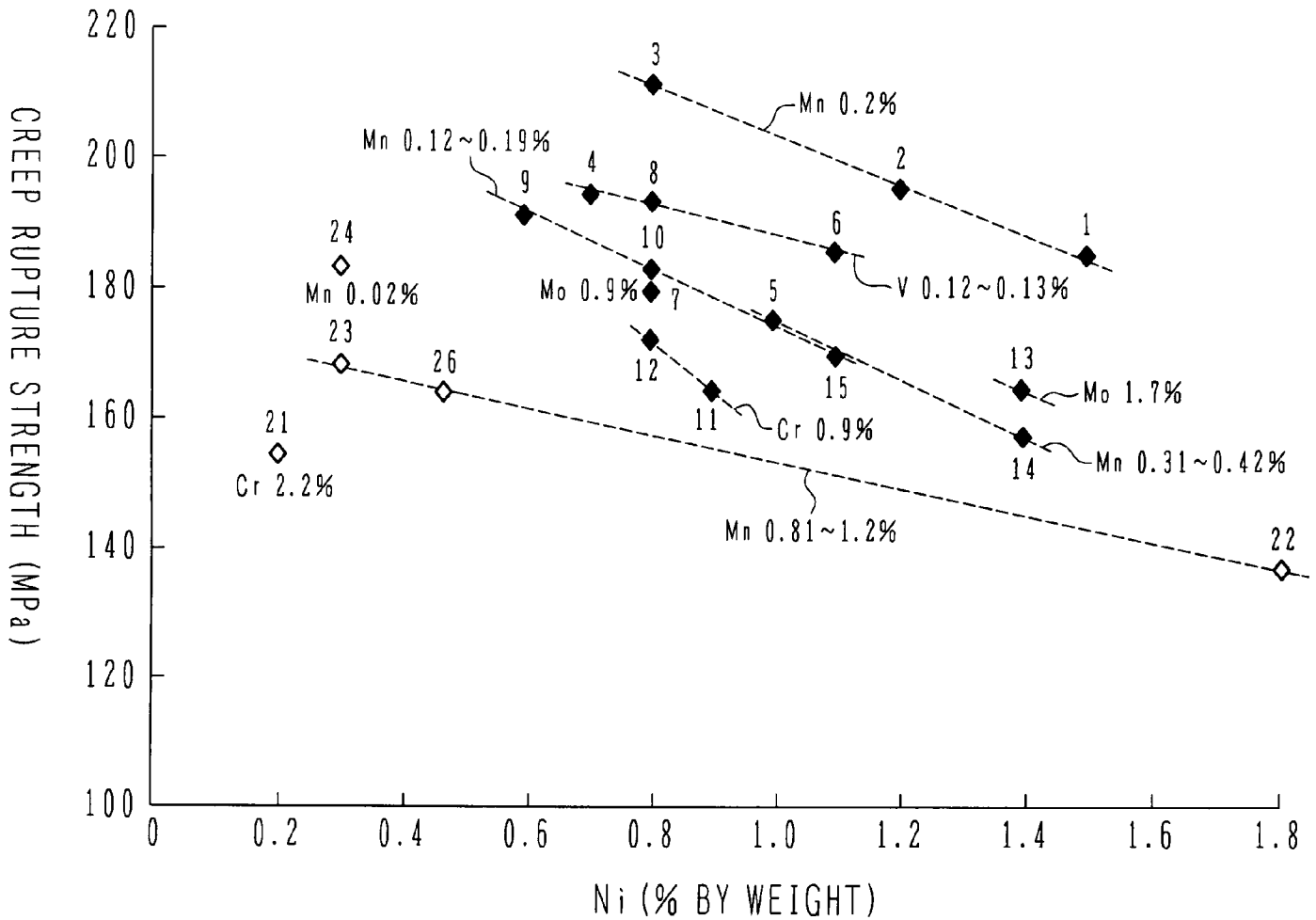
FIG. 5 is a graph showing the relationship between an amount of added Ni and creep rupture strength.

FIG. 5 is a graph showing the relationship between the Ni amount and creep rupture strength on condition of 538° C.×$10^5$ hours. As compared with the comparative steel having the Mn amount of 0.81-1.20%, the steel of the invention having the Mn amount of 0.05-0.5% exhibits high creep rupture strength when the Ni amount is in a specific range of 0.5-1.5%. Further, the creep rupture strength of any kind of heat resisting steel is reduced as the Ni amount increases. In particular, maximum creep rupture strength is obtained at the Mn amount of 0.2%. It is therefore understood that high creep rupture strength is obtained at the Mn amount of 0.15-0.35%.

To examine embrittlement characteristics of the steel sample No. 3 of the invention and the comparative steel sample No. 26 (currently used for a high-pressure steam rotor), 50%-FATT was measured by making an impact test at 20° C. on the samples before and after being subjected to an embrittlement process of holding each sample under conditions of 500° C.×3000 hours. FATT of the comparative steel sample No. 26 was changed from 95° C. before the embrittlement process to 128° C. (ΔFATT=33CC) after the embrittlement process. Thus, the embrittlement process increased FATT (namely, accelerated embrittlement). In contrast, it was confirmed that FATT of the steel sample No. 3 of the invention was the same, i.e., 103° C., before and after the embrittlement process, and the steel of the invention showed substantially no embrittlement.

Figure 6:
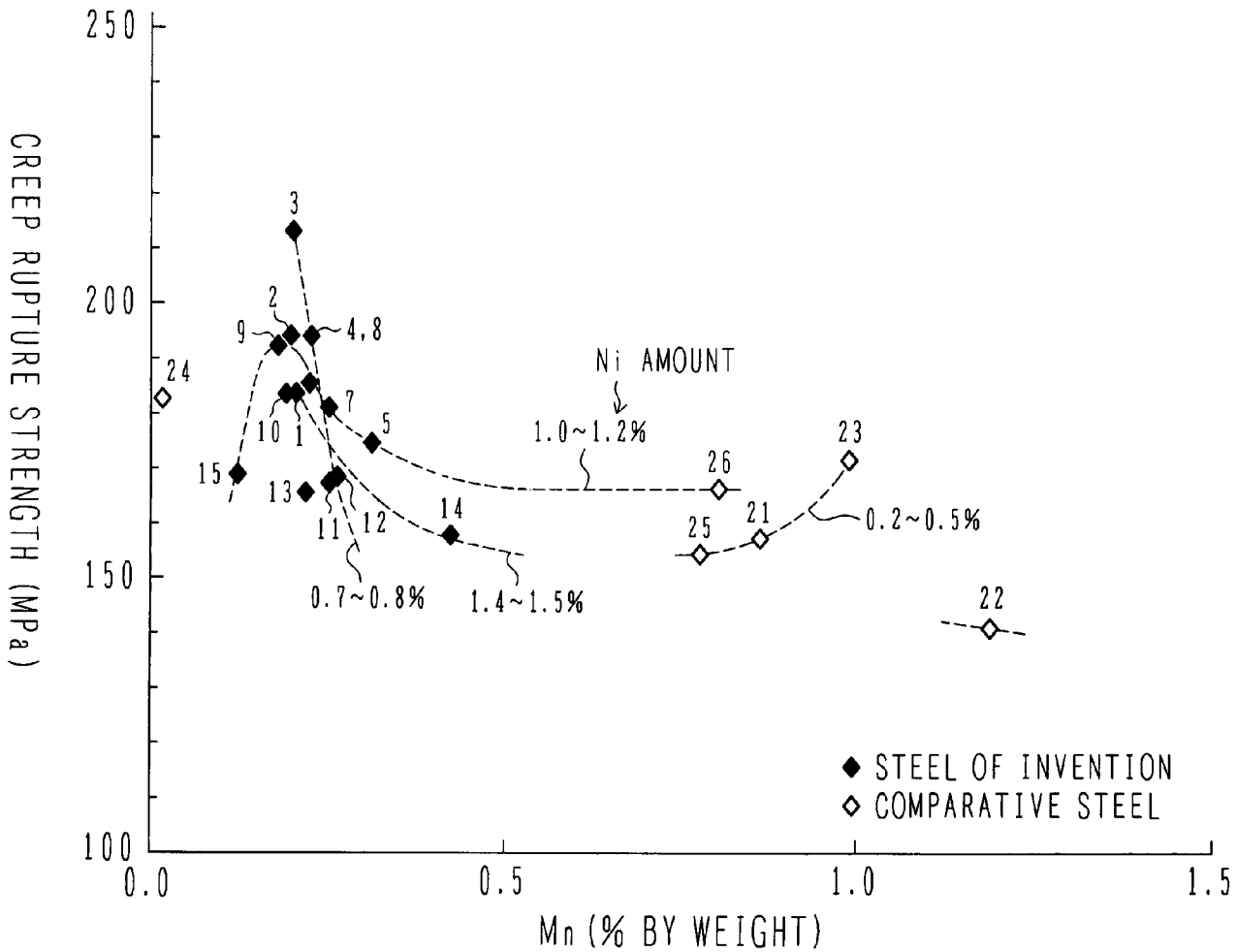
FIG. 6 is a graph showing the relationship between an amount of added Mn and creep rupture strength.

FIG. 6 is a graph showing the relationship between the Mn amount and the creep rupture strength on condition of 538° C.×$10^5$ hours. The steel of the invention exhibits high creep rupture strength when the Mn amount is in a specific range of 0.05-0.5%. In particular, at any Ni amount, maximum creep rupture strength is obtained when the Mn amount is 0.15-0.35%. Further, the highest creep rupture strength is obtained when the Ni amount of 0.7-0.8%.

Figure 7:
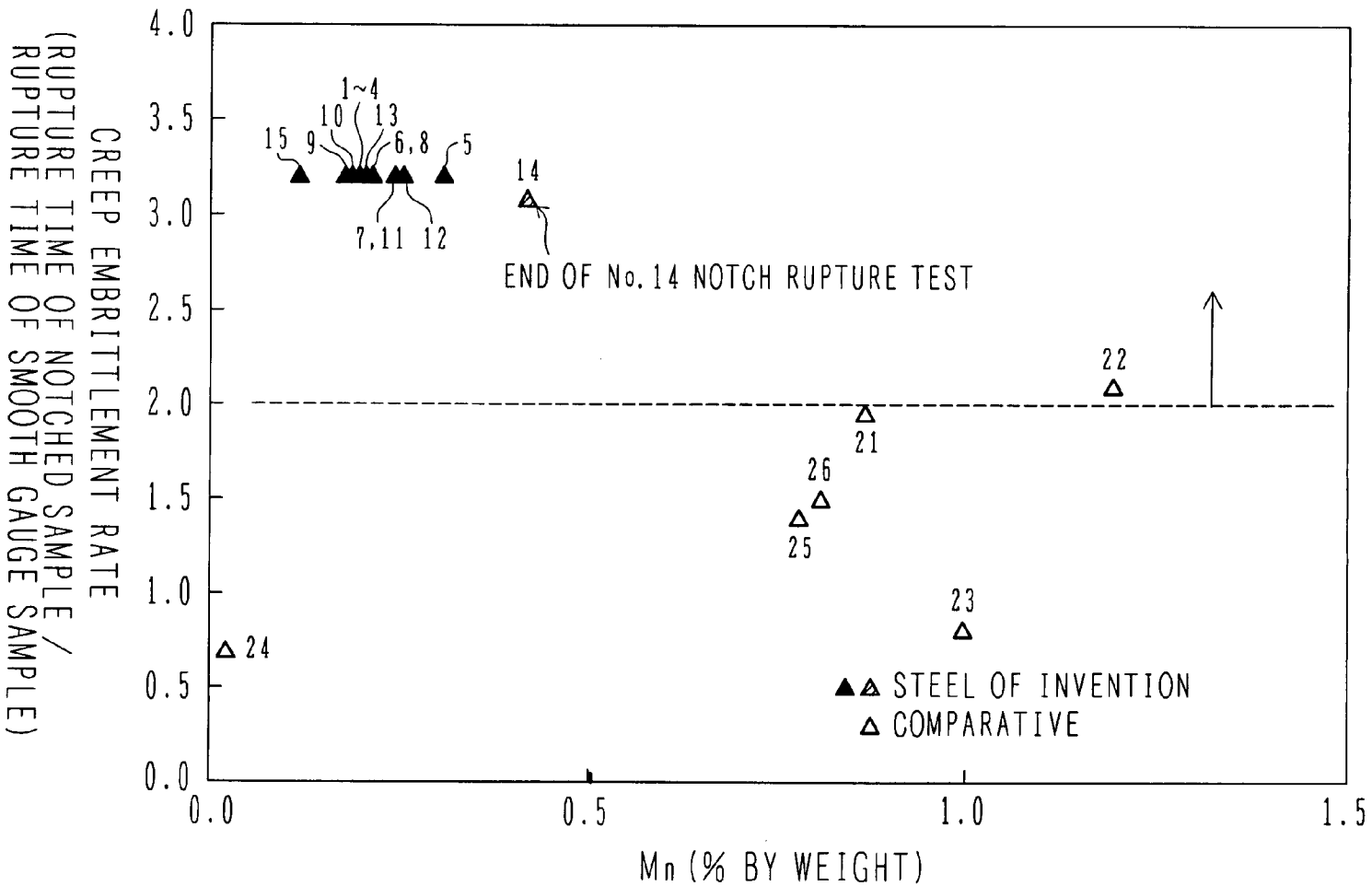
FIG. 7 is a graph showing the relationship between an amount of added Mn and a creep embrittlement rate.

FIG. 7 is a graph showing the relationship between the Mn amount and the creep embrittlement rate, i.e., the ratio of (rupture time of a notched sample/rupture time of a smooth gauge sample). The notch rupture test on the steel sample No. 14 of the invention is ended, but the notch rupture test on the other steel samples of the invention is still continued. The sample No. 24 having the Mn amount of 0.02% at a minimum level exhibits low notch rupture strength, and the samples having the Mn amounts of not less than 0.78% represented by No. 25 also exhibit low notch rupture strength. On the other hand, it is apparent that a high creep embrittlement rate of not less than 3 is obtained with the Mn amount range of 0.05-0.5% as defined in the present invention.

As seen from the above description, the heat resisting steel of the present invention has not only superior reliability in use at high temperatures, but also superior manufacturability.

EXAMPLE 2

Figure 8:
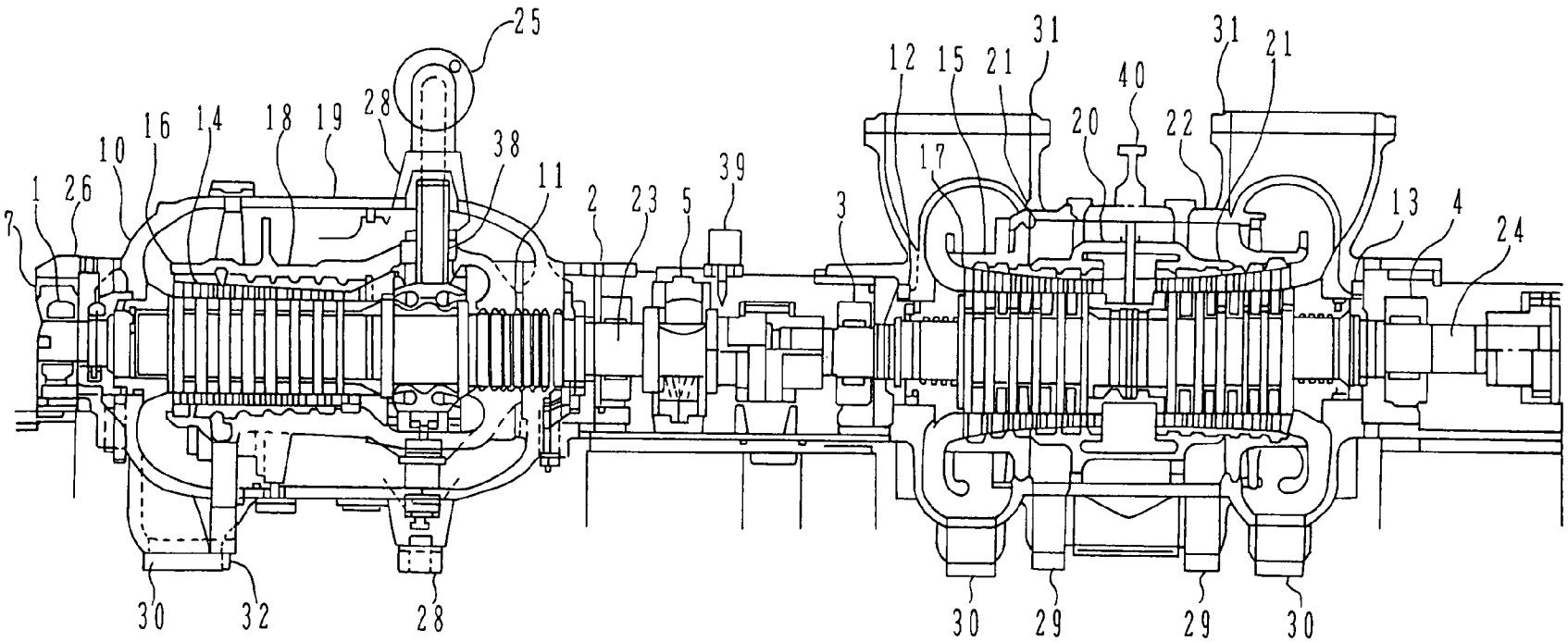
FIG. 8 is a sectional view of a high-pressure steam turbine and an intermediate-pressure steam turbine according to the present invention, which are both coupled to one shaft.

FIG. 8 is a sectional view of a high-pressure steam turbine and an intermediate-pressure steam turbine, which are both coupled to one shaft. The high-pressure steam turbine comprises a high-pressure inner casing 18, a high-pressure outer casing 19 surrounding the inner casing 18, and a high-pressure axle (high-pressure rotor shaft) 23 disposed within those casings and including high-pressure moving blades 16 mounted thereto. High-temperature and high-pressure steam at 538° C. or 566° C. is obtained from a boiler and introduced to a dual-flow moving blade in an initial stage from a nozzle box 38 after passing through a main steam pipe, a flange/elbow 25 constituting a steam inlet passage, and a main steam inlet 28. The initial stage is of a dual-flow structure, and the other eight stages are disposed on one side. Stator blades are disposed in one-to-one relation to the moving blades. The moving blades are each of saddle-dovetailed type with double-tendon mount, and the initial-stage blade has a length of about 35 mm. The axle has a length of about 5.8 m and a diameter of about 710 mm in the narrowest portion corresponding to each stator blade portion.

Figure 9:
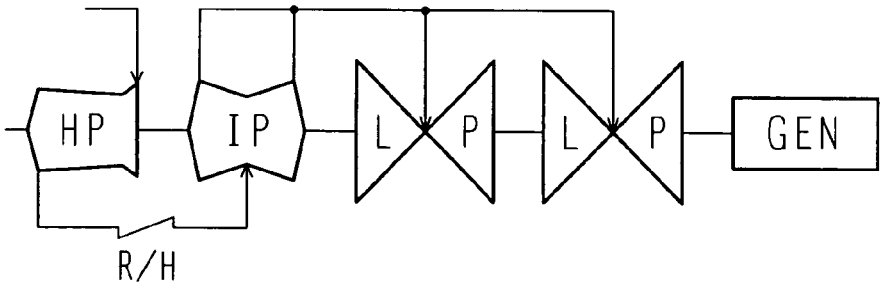
FIG. 9 is a block diagram of a steam turbine power plant according to the present invention, in which a high-pressure steam turbine (HP), an intermediate-pressure steam turbine (IP), one or two low-pressure steam turbines (LP), and a generator (GEN) are arranged in tandem compound layout.
Figure 10:
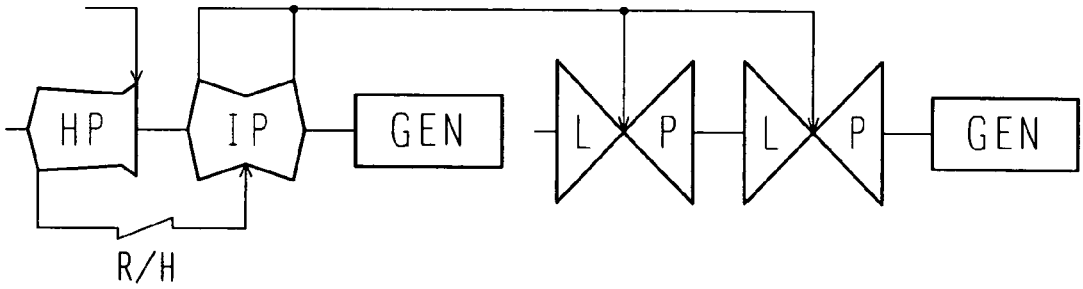
FIG. 10 is a block diagram of a steam turbine power plant according to the present invention, in which a high-pressure steam turbine (HP), an intermediate-pressure steam turbine (IP), a generator (GEN), two low-pressure steam turbines (LP), and a generator (GEN) are arranged in cross compound layout.

FIG. 9 shows a steam turbine power plant in which a high-pressure steam turbine (HP), an intermediate-pressure steam turbine (IP), one or two low-pressure steam turbines (LP), and a generator (GEN) are arranged in tandem compound layout. FIG. 10 shows a steam turbine power plant in which a high-pressure steam turbine (HP), an intermediate-pressure steam turbine (IP), a generator (GEN), two low-pressure steam turbines (LP), and a generator (GEN) are arranged in cross compound layout. The steam discharged from the high-pressure steam turbine (HP) is heated by a reheater (R/H) and introduced to the intermediate-pressure steam turbine (IP).

Figure 11:
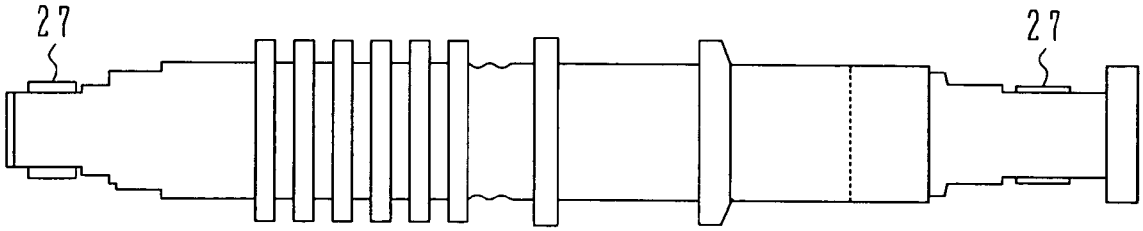
FIG. 11 is a front view of a rotor shaft of the high-pressure steam turbine according to the present invention.
Figure 12:
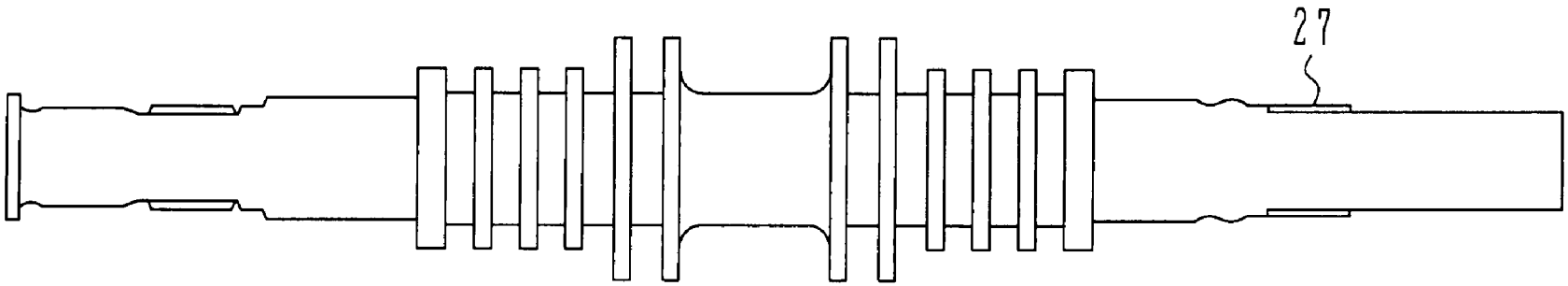
FIG. 12 is a front view of a rotor shaft of the intermediate-pressure steam turbine according to the present invention.

FIG. 11 is a front view of a rotor shaft of the high-pressure steam turbine, and FIG. 12 is a front view of a rotor shaft of the intermediate-pressure steam turbine. As shown, any of the rotor shafts is formed such that, a shaft portion to which the moving blade is mounted has a larger diameter than a barrel portion. In this Example 2, the heat resisting steel described in Example 1 is used for the rotor shafts of the high-pressure steam turbine and the intermediate-pressure steam turbine. As a result, a harmful phase, e.g., segregation, was not detected in the process of manufacturing a steel ingot, and superior manufacturability was obtained in points of melting, forging and hot plastic workability. After the working, the rotor shaft was subjected to heat treatment in the same manner as that in Example 1. The heating and holding time in the heat treatment is prolonged depending on the volume of the rotor shaft.

The heat resisting steel as materials of the rotor shaft in this Example 2 had FATT of not higher than 121° C., the room-temperature tensile strength of not less than 725 MPa, the 0.02%-proof stress of not less than 585 MPa, the elongation of not less than 17%, the reduction of area of not less than 43%, and the creep rupture strength of not less than 150 MPa on condition of 538° C.×$10^5$ hours. The use of that heat resisting steel raised the durable temperatures of high- and intermediate-pressure rotor shafts, and also improved reliability in prevention of the creep embrittlement. As a result, the outputs of the high- and intermediate-pressure steam turbines were increased and the turbine efficiency was improved.

Thus, it is possible to increase the steam turbine output by utilizing the steam temperature of 538° C. or 566° C. without employing more severe steam conditions, and to constitute a turbine with higher performance. Further, since power generation with higher efficiency is realized, fossil fuel can be saved, which contributes to promoting protection of global environments.

EXAMPLE 3

Figure 13:
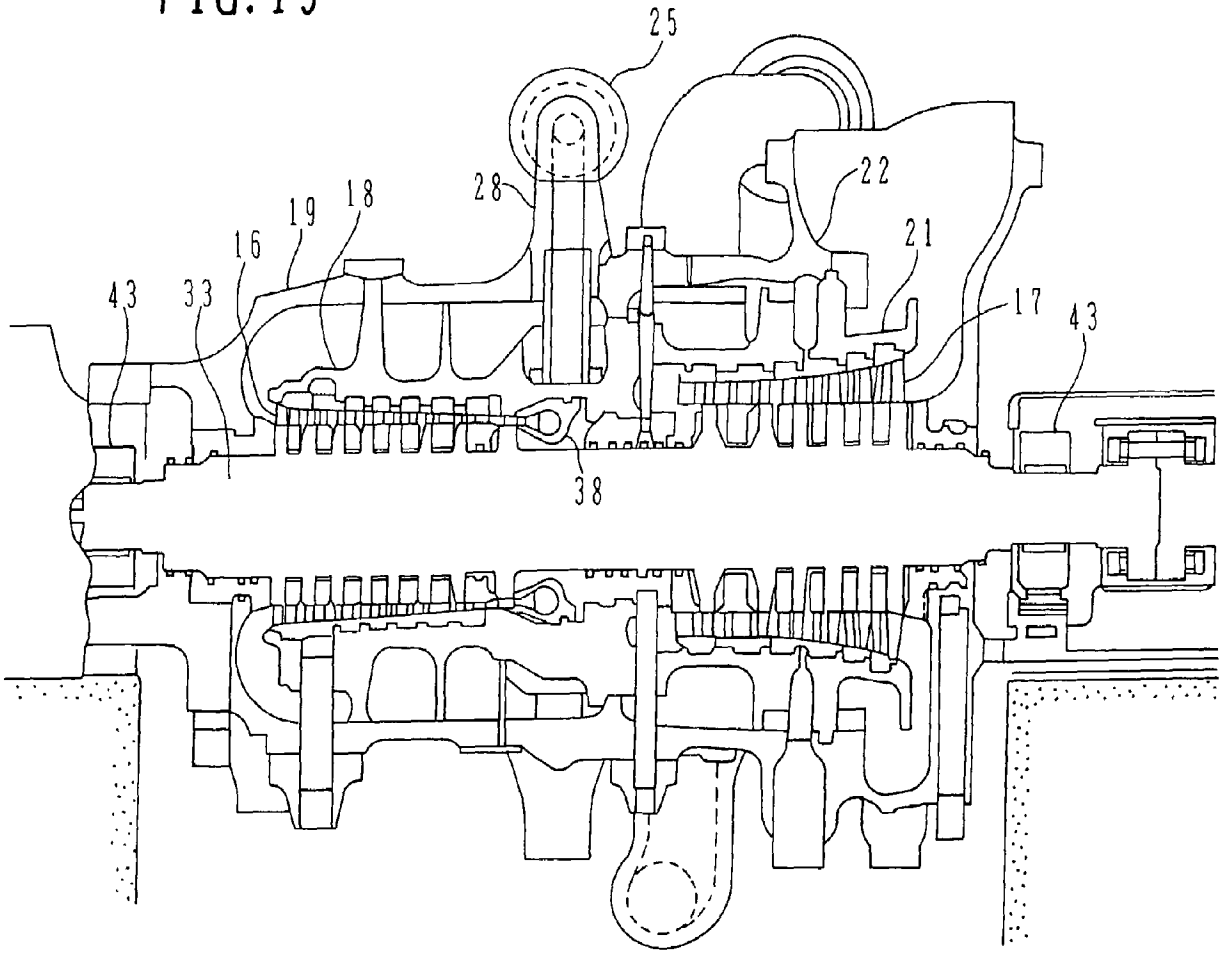
FIG. 13 is a sectional view of a high/intermediate-pressure integral steam turbine according to the present invention.

FIG. 13 is a sectional view of a high/intermediate-pressure integral steam turbine according to the present invention, in which a high-pressure steam turbine and an intermediate-pressure steam turbine are integrated with each other. The high-pressure steam turbine comprises a high-pressure inner casing 18, a high-pressure outer casing 19 surrounding the inner casing 18, and a high/intermediate-pressure axle (high/intermediate-pressure integral rotor shaft) 33 disposed within those casings and including high-pressure moving blades 16 mounted thereto. High-temperature and high-pressure steam is obtained from a boiler and introduced to a moving blade in an initial stage from a nozzle box 38 after passing through a main steam pipe, a flange/elbow 25 constituting a steam inlet passage, and a main steam inlet 28. In the illustrated structure, the steam enters the turbine from the central side of the rotor shaft and flows toward the bearing 43 side.

The steam discharged from the high-pressure steam turbine is heated by a reheater (R/H) and introduced to the intermediate-pressure side. The intermediate-pressure steam turbine rotates a generator in cooperation with the high-pressure steam turbine. As in the high-pressure steam turbine, the intermediate-pressure steam turbine comprises an intermediate-pressure inner casing 21, an intermediate-pressure outer casing 22, and intermediate-pressure moving blades 17 mounted in one-to-one opposed relation to stator blades.

Figure 14:
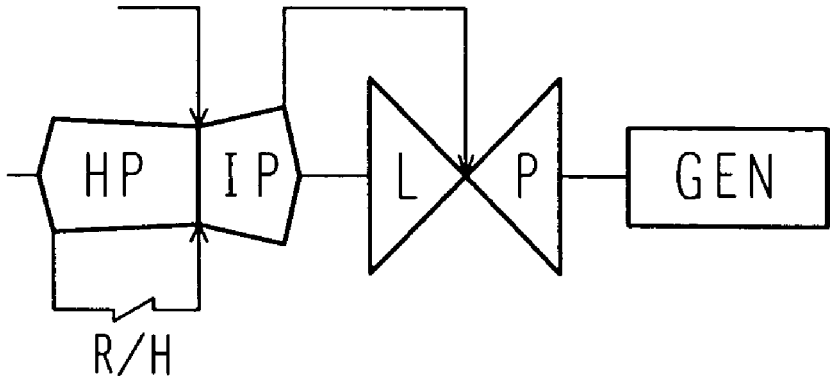
FIG. 14 is a block diagram of a steam turbine power plant according to the present invention, in which a high/intermediate-pressure steam turbine (HP/IP), one low-pressure steam turbine (LP), and a generator (GEN) are arranged in tandem compound layout.
Figure 15:
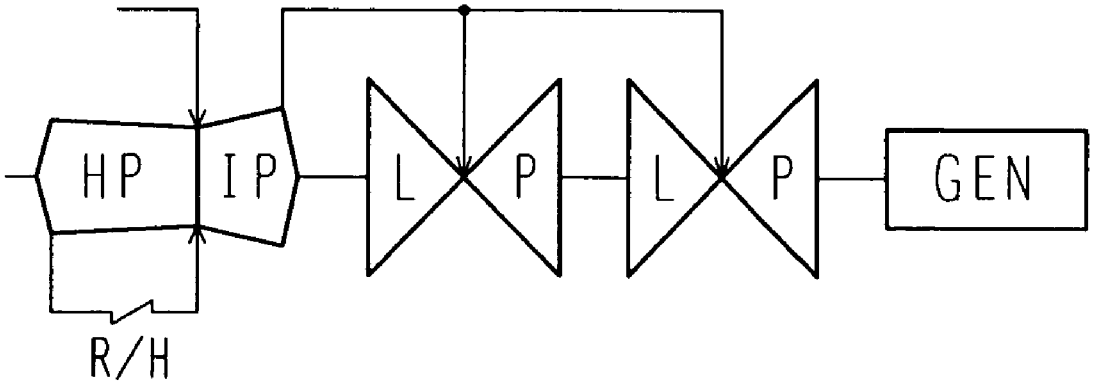
FIG. 15 is a block diagram of a steam turbine power plant according to the present invention, in which a high/intermediate-pressure steam turbine (HP/IP), two low-pressure steam turbines (LP), and a generator (GEN) are arranged in tandem compound layout.

FIG. 14 shows a steam turbine power plant in which a high/intermediate-pressure steam turbine (HP/IP), one low-pressure steam turbine (LP), and a generator (GEN) are arranged in tandem compound layout. FIG. 15 shows a steam turbine power plant in which a high/intermediate-pressure steam turbine (HP/IP), two low-pressure steam turbines (LP), and a generator (GEN) are arranged in tandem compound layout.

Figure 16:
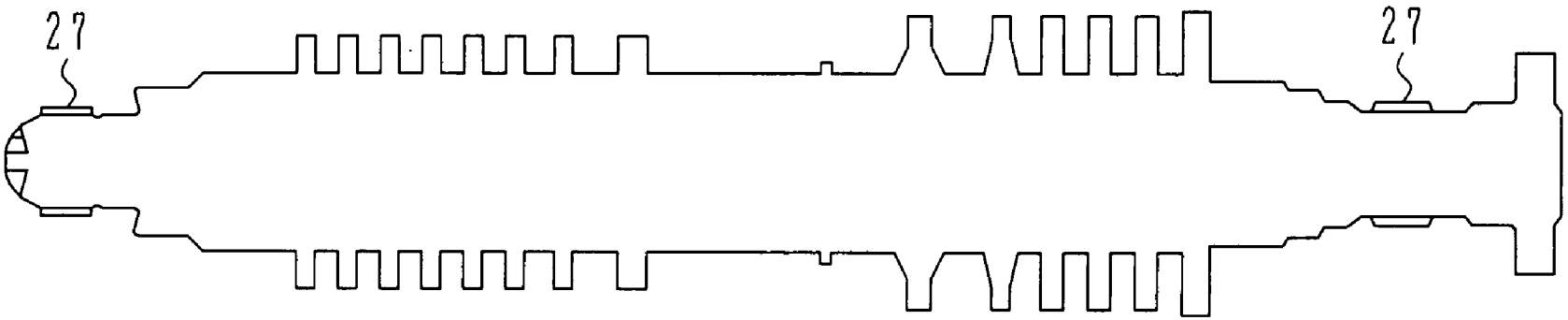
FIG. 16 is a front view of a rotor shaft of the high/intermediate-pressure steam turbine according to the present invention.

FIG. 16 is a front view of the rotor shaft of the high/intermediate-pressure steam turbine. As shown, the rotor shaft 33 is formed such that a shaft portion to which the moving blade is mounted has a larger diameter than a barrel portion. The high/intermediate-pressure rotor shaft 33 used in this Example 3 was made of the Cr—Mo—V steel, described in Example 1, having the totally Bainite structure. As a result, a harmful phase, e.g., segregation, was not detected in the process of manufacturing a steel ingot, and superior manufacturability was obtained in points of melting, forging and hot plastic workability. After the working, the rotor shaft was subjected to heat treatment in the same manner as that in Example 1. The inlet steam temperature in this Example 3 was 538° C. or 566° C.

The heat resisting steel as materials of the rotor shaft in this Example 3 had FATT of not higher than 121° C., the room-temperature tensile strength of not less than 725 MPa, the 0.02%-proof stress of not less than 585 MPa, the elongation of not less than 17%, the reduction of area of not less than 43%, and the creep rupture strength of not less than 150 MPa on condition of 538° C.$\times 10^5$ hours. The use of that heat resisting steel raised the durable temperature of high/intermediate-pressure rotor shaft, and also improved reliability in prevention of the creep embrittlement. As a result, the output of the high/intermediate-pressure steam turbine was increased and the turbine efficiency was improved.

According to the present invention, since a rotor shaft superior in the creep rupture strength and the notch rupture strength is obtained, it is possible to increase the steam turbine output without employing more severe steam conditions, and to constitute a turbine with higher performance. Further, since power generation with higher efficiency is realized, fossil fuel can be saved, which contributes to promoting protection of global environments.

What is claimed is:

1. A heat resisting steel made of a Cr—Mo—V low-alloy steel containing 0.15-0.40% by weight of C, not more than 0.5% of Si, 0.05-0.50% of Mn, 0.5-1.5% of Ni, 0.8-1.5% of Cr, 0.8-1.8% of Mo and 0.05-0.35% of V, and having a (Ni/Mn) ratio of 3.0-10.0; and wherein the Cr—Mo—V low-alloy steel has a ratio of (rupture time of a notched sample/rupture time of a smooth gauge sample) being not less than 2 in a creep test at the same temperature and under the same stress.

2. The heat resisting steel according to claim 1, wherein the heat resisting steel is made of the Cr—Mo—V low-alloy steel modified in composition to contain 0.65-0.95% of Ni and have a (Ni/Mn) ratio of 3.5-7.0.

3. The heat resisting steel according to claim 1, wherein the heat resisting steel is made of the Cr—Mo—V law-alloy steel modified in composition to contain 0.95-1.35% of Ni and have a (Ni/Mn) ratio of 4-8.

4. The heat resisting steel according to claim 1, wherein the heat resisting steel is made of the Cr—Mo—V low-alloy steel modified in composition to contain 1.35-1.5% of Ni and have a (Ni/Mn) ratio of 5.5-10.0.

5. The heat resisting steel according to claim 1, wherein the heat resisting steel is made of the Cr—Mo—V low-alloy steel modified in composition to contain 0.5-1.5% of Ni and have a (Cr/Mn) ratio of 3.5-14.0.

6. The heat resisting steel according to claim 5, wherein the heat resisting steel is made of the Cr—Mo—V low-alloy steel modified in composition to contain 0.65-0.95% of Ni and have a (Cr/Mn) ratio of 3.5-9.0.

7. The heat resisting steel according to claim 5, wherein the heat resisting steel is made of the Cr—Mo—V low-alloy steel modified in composition to contain 0.95-1.35 % of Ni and have a (Cr/Mn) ratio of 3.5-8.5.

8. The heat resisting steel according to claim 6, wherein the heat resisting steel is made of the Cr—Mo—V low-alloy steel modified in composition to contain 1.35- 1.5% of Ni and have a (Cr/Mn) ratio of 5.0 -8.0.

9. The heat resisting steel according to claim 1, wherein the Cr—Mo—V low-alloy steel has smooth-gauge creep rupture strength of not less than 150 MPa on condition of 538 ° C.×100,000 hours.

10. A steam turbine rotor shaft made of the heat resisting steel according to claim 1.

11. A steam turbine comprising a rotor shaft, moving blades mounted to said rotor shaft, stator blades for guiding steam to flow toward said moving blades, and an inner casing for supporting said stator blades, the steam flowing into an initial stage of said moving blades and flowing out from a final stage thereof at high pressure, wherein said rotor shaft is the rotor shaft according to claim 10.

12. The steam turbine according to claim 11, wherein said steam turbine is any of a high-pressure steam turbine, an intermediate-pressure steam turbine, and a high/intermediate-pressure integral steam turbine in which the high-pressure steam turbine and the intermediate-pressure steam turbine are integrated with each other.

13. A steam turbine power plant of tandem compound type comprising a high-pressure steam turbine, an intermediate-pressure steam turbine, one or two low-pressure steam turbines coupled in tandem, and a generator, wherein at least one of said high-pressure steam turbine and said intermediate-pressure steam turbine is the steam turbine according to claim 11.

14. A steam turbine power plant of cross compound type that a high-pressure steam turbine, an intermediate-pressure steam turbine and a generator are arranged in tandem, one or two low-pressure steam turbines coupled in tandem and a generator are arranged in tandem, and steam exiting said intermediate-pressure steam turbine is supplied to said low-pressure steam turbine, wherein at least one of said high-pressure steam turbine and said intermediate-pressure steam turbine is the steam turbine according to claim 11.

15. A steam turbine power plant of tandem compound type comprising a high/intermediate-pressure integral steam turbine in which a high-pressure steam turbine and an intermediate-pressure steam turbine are integrated with each other, one or two low-pressure steam turbines coupled in tandem, and a generator, wherein said high/intermediate-pressure steam turbine is the steam turbine according to claim 11.

16. A heat resisting steel made of a Cr—Mo—V low-alloy steel containing 0.23-0.32% by weight of C, 0.01-0.05% of Si, 0.15-0.35% of Mn, 0.7-1.2% of Ni, 0.8-1.5% of Cr, 0.8-1.8% of Mo and 0.10-0.30% of V, and having a (Ni/Mn) ratio of 3.0-10.0; and wherein the Cr—Mo—V low-alloy steel has a ratio of (rupture time of a notched sample/rupture time of a smooth gauge sample) being not less than 2 in a creep test at the same temperature and under the same stress.

17. A high-pressure steam turbine comprising a rotor shaft, moving blades mounted to said rotor shaft, stator blades for guiding steam to flow toward said moving blades, and an inner casing for supporting said stator blades, the steam flowing into an initial stage of said moving blades and flowing out from a final stage thereof at high pressure, wherein said rotor shaft is made of a Cr—Mo—V low-alloy steel containing 0.15 -0.40% by weight of C, not more than 0.5% of Si, 0.05-0.50% of Mn, 0.5- 1.5% of Ni, 0.8-1.5% of Cr, 0.8-1.8% of Mo, and 0.05-0.35% of V; and wherein the Cr—Mo—V low-alloy steel has a ratio of (rupture time of a notched sample/rupture time of a smooth gauge sample) being not less than 2 in a creep test at the same temperature and under the same stress.

18. An intermediate-pressure steam turbine comprising a rotor shaft, moving blades mounted to said rotor shaft, stator blades for guiding steam to flow toward said moving blades, and an inner casing for supporting said stator blades, the steam flowing into an initial stage of said moving blades and flowing out from a final stage thereof at high pressure, wherein said rotor shaft is made of a Cr—Mo—V low-alloy steel containing 0.15-0.40% by weight of C, not more than 0.5% of Si, 0.05-0.50% of Mn, 0.5-1.5% of Ni, 0.8-1.5% of Cr, 0.8-1.8% of Mo, and 0.05-0.35% of V; and wherein the Cr—Mo—V low-alloy steel has a ratio of (rupture time of a notched sample/rupture time of a smooth gauge sample) being not less than 2 in a creep test at the same temperature and under the same stress.

19. A high/intermediate-pressure integral steam turbine comprising a rotor shaft, moving blades mourned to said rotor shaft, stator blades for guiding steam to flow toward said moving blades, and an inner casing for supporting said stator blades, the steam flowing into an initial stage of said moving blades and flowing out from a final stage thereof at high pressure, wherein said rotor shaft is made of a Cr—Mo—V low-alloy steel containing 0.15-0.40% by weight of C, not more than 0.5% of Si, 0.05 -0.50% of Mn, 0.5-1.5% of Ni, 0.8-1.5% of Cr, 0.8-1.8% of Mo, and 0.05-0.35% of V; and wherein the Cr—Mo—V low-alloy steel has a ratio of (rupture time of a notched sample/rupture time of a smooth gauge sample) being not less than 2 in a creep test at the same temperature and under the same stress.

* * * * *